United States Patent [19]

Graziadio et al.

[11] Patent Number: 4,708,293

[45] Date of Patent: Nov. 24, 1987

[54] ATOMIZER FOR VISCOUS LIQUID FUELS

[75] Inventors: Mario Graziadio; Sergio Ligasacchi, both of Piza, Italy

[73] Assignee: Enel-Ente Nazionale per l'Energie Elettrica, Rome, Italy

[21] Appl. No.: 888,885

[22] Filed: Jul. 23, 1986

Related U.S. Application Data

[63] Continuation-in-part of Ser. No. 815,126, Dec. 30, 1985, abandoned, which is a continuation of Ser. No. 565,276, Dec. 27, 1983, abandoned.

[30] Foreign Application Priority Data

Feb. 24, 1983 [IT] Italy ..... 19729 A/83
Jul. 14, 1986 [EP] European Pat. Off. ..... 86830199.5

[51] Int. Cl.[4] ..... B05B 7/04

[52] U.S. Cl. ..... 239/427; 239/430; 239/433

[58] Field of Search ..... 239/429–431, 239/433, 434, 427

[56] References Cited

U.S. PATENT DOCUMENTS 982,655 1/1911 Albee ..... 239/431
1,598,996 9/1926 Wheelock ..... 239/429
1,999,121 4/1935 Wilson ..... 239/430
2,946,185 7/1960 Bayer ..... 239/429 X
3,498,545 3/1970 Short ..... 239/430 X

FOREIGN PATENT DOCUMENTS 1445889 8/1976 United Kingdom ..... 239/429

*Primary Examiner*—Andres Kashnikow
*Assistant Examiner*—Daniel R. Edelbrock
*Attorney, Agent, or Firm*—Peter K. Kontler

[57] ABSTRACT

The improved atomizer comprises a first and a second mixer for a fuel delivered through a central inlet and for an atomizing fluid delivered through a peripheral inlet, the first mixer including a first mixing chamber whereto the fuel arrives from the central inlet and the atomizing fluid arrives from peripheral ducts, and the second mixer including a second mixing chamber for the fuel and the atomizing fluid that complete their mixing therein and a plurality of outlets for the delivery of the completely atomized fuel to a firebox, the relations among the length, diameter and cross-sectional area of certain parts of the atomizer being defined to impart an effective atomization to the fuel and supply a superior jet of atomized fuel to the firebox.

8 Claims, 1 Drawing Figure

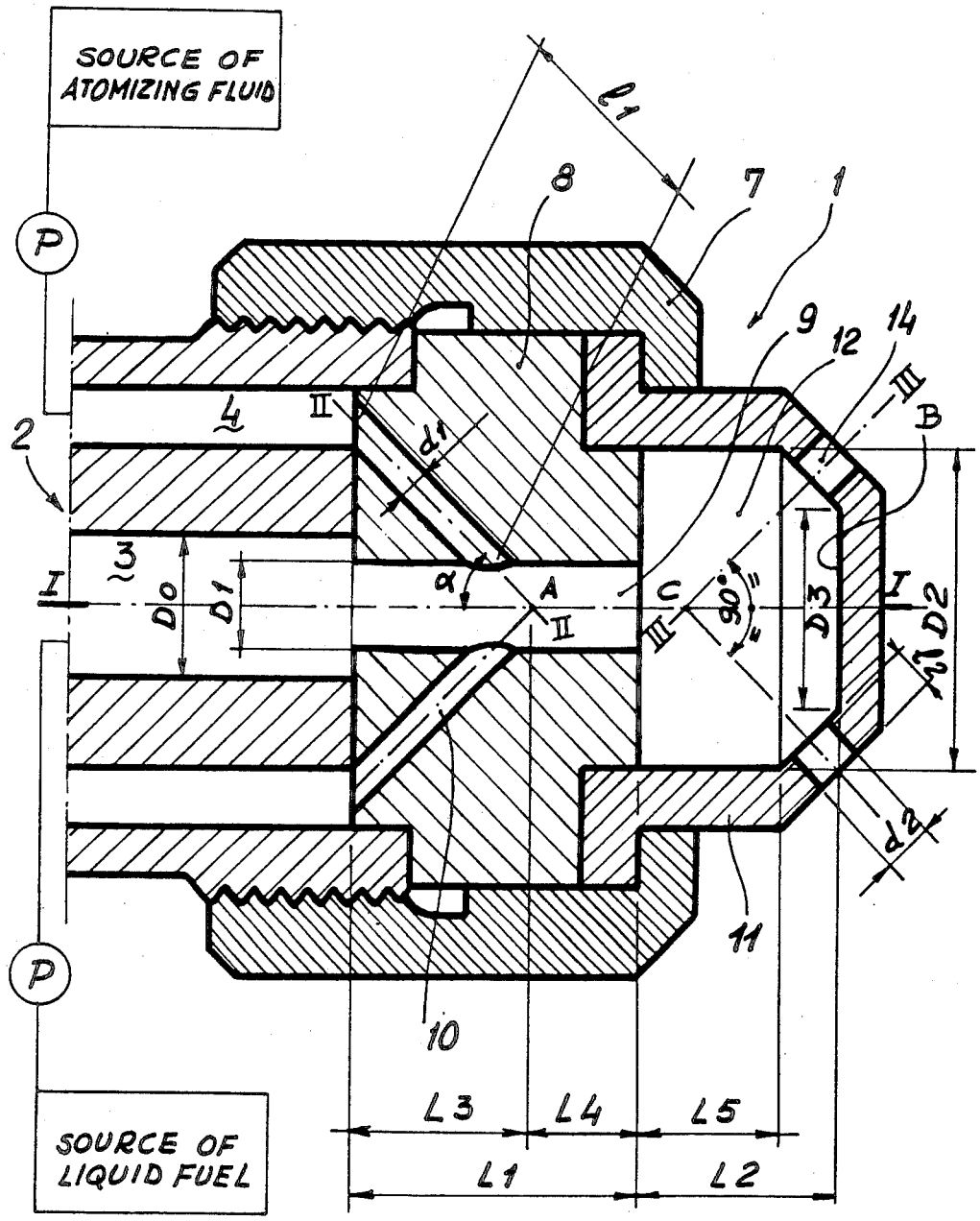
SOURCE OF ATOMIZING FLUID
SOURCE OF LIQUID FUEL
P
P
2
3
4
I
I
II
II
III
III
A
B
C
α
90°
d1
d2
D0
D1
D2
D3
l1
8
7
1
9
12
14
10
11
L1
L2
L3
L4
L5

ATOMIZER FOR VISCOUS LIQUID FUELS

CROSS-REFERENCE TO RELATED APPLICATIONS

This application is a continuation-in-part of Ser. No. 815,126 filed Dec. 30, 1985 and now abandoned which, in turn, is a continuation of Ser. No. 565,276 filed Dec. 27, 1983 and now abandoned.

BACKGROUND OF THE INVENTION

The present invention relates to improvements in an atomizer for viscous liquid fuels.

Particularly, the invention relates to an improved atomizer suitable for a burner for high viscosity liquid fuels of for two-phase mixtures such as, for instance, coal-fuel oil or coal-water, having high viscosity and, in either case, with the assistance of air or steam as an atomizing fluid.

In the patent application Ser. No. 565,276, now abandoned, the applicant discloses an atomizer which comprises a first and a second mixer for a fuel delivered through a central inlet means and for an atomizing fluid delivered through a peripheral inlet means. The first mixer includes a first mixing chamber whereto the fuel arrives from the central inlet means and the atomizing fluid arrives from the peripheral ducts. The second mixer includes a second mixing chamber for the fuel and the atomizing fluid that complete their mixing therein and includes a plurality of outlet means for the delivery of the completely atomized fuel to a firebox. The cross sectional area and the length of said central inlet means greatly exceed the cross sectional area and the length of said first mixing chamber, respectively; the cross sectional area of said second mixing chamber is several times that of said first mixing chamber; the slope of said peripheral ducts and of said outlet means with respect to the longitudinal axis of the atomizer are within certain ranges of angular values.

SUMMARY OF THE INVENTION

The present invention relates to an atomizer of the type described above wherein certain features of certain parts and certain relations between the dimensions of the parts, which are responsible for imparting an effective atomization to the fuel and creating a superior jet of atomized fuel, have been better defined by trials and model tests.

BRIEF DESCRIPTION OF THE DRAWING

The description of the invention is supplied below with reference to the attached sole FIGURE which is a longitudinal cross sectional view of an atomizer shown as an example of the invention.

DESCRIPTION OF THE PREFERRED EMBODIMENTS

In general, the improved atomizer still comprises known features such as a central inlet means 3 for liquid fuel, a peripheral inlet means 4 for atomizing fluid, a first cylindrical mixing chamber 9 to which which a plurality of peripheral ducts 10 conduct the fluid that atomizes the liquid fuel coming from said central inlet means 3, and a second mixing chamber 12 which receives the partly atomized liquid fuel from the first cylindrical mixing chamber 9 and has a plurality of outlet means 14 for delivering the completely atomized fuel to a firebox, the longitudinal axis 1—1 of the atomizer being the longitudinal axis of symmetry common to the central inlet means and to the first and second mixing chambers.

In particular the atomizer 1 is held on the device 2 by a ring nut 7 screwed on a thread of the device 2. The atomizer 1 comprises a first mixer 8 which contains a first cylindrical mixing chamber 9 in communication with a central inlet means 3 for the liquid fuel and also contains a plurality $n_1$ of peripheral ducts 10 (only two shown), angularly spaced by $360°/n_1$, for delivering to the chamber 9 the atomizing fluid coming from a peripheral inlet means 4. The peripheral ducts 10 are so directed that their longitudinal axes II—II cross at point A on the longitudinal axis I—I, the point A dividing the length of the chamber 9 into two lengths. The atomizer 1 comprises also a second mixer 11 which contains a second mixing chamber 12 having a first cylindrical portion and a second conical portion. A plurality of outlet means 14 (two only are shown) are provided in the conical wall, the axes III—III of the outlet means 14 being perpendicular to the inner and outer conical walls of the mixer 11 and crossing at a point C within the chamber 12. The end wall B opposite to the chamber 9 is perpendicular to the axis I—I.

The diameter of the central inlet means 3 is $D_o$; the diameter of the chamber 9 is $D_1$; the diameter of the cylindrical portion of the chamber 12 is $D_2$; and the diameter of the end wall B is $D_3$.

The diameter of each peripheral duct 10 is $d_1$; and the diameter of each outlet means 14 is $d_2$. The cross sectional area of each of the ducts 10 is $s_1$.

The length of the chamber 9 is $L_1$, divided by the crossing point A into two lengths, $L_3$ and $L_4$; the overall length of the second mixing chamber 12 is $L_2$ and the length of the cylindrical portion of the chamber 12 is $L_5$. The outlet means 14 have inner and outer sharp edges.

The length of the peripheral ducts 10 is $l_1$; and the length of the outlet means 14 is $l_2$.

More particularly, the ratio between the diameter $D_o$ of said central inlet means 3 and the diameter $D_1$ of the first cylindrical mixing chamber 9 is $D_o/D_1>2$; the plurality of peripheral ducts which conduct the atomizing fluid to the first cylindrical mixing chamber 9 comprises at least three ducts 10, the ducts 10 being equally angularly spaced and having equal length $l_1$, and equal diameter $d_1$ and their longitudinal axes crossing at a common point A on said longitudinal axis I—I within the first cylindrical mixing chamber 9; and the second mixing chamber 12 has an overall length $L_2$ and is divided into a first portion of cylindrical cross section having length $L_5$ and diameter $D_2$ such that $L_5/D_2>0.6$, and a second portion of conical shape comprising a plurality of outlet means 14, the axes III—III of the outlet means 14 being perpendicular to the inner conical wall and crossing at a common point C on said longitudinal axis I—I within said first portion, the end inner wall B of the conical portion being a circular wall having a diameter $D_3$ such that $D_3 \geqq D_1$, said end wall being perpendicular to said longitudinal axis I—I.

Said crossing point A divides the length $L_1$ of the first cylindrical mixing chamber 9 in two lengths, a first one $L_3$ adjacent to the central inlet means 3 and a second one $L_4$ adjacent to the second mixing chamber 12, such that the relation between each of said two lengths and the diameter $D_1$ of the first cylindrical mixing chamber 9 is $L_3 \leqq 2D_1$ and $L_4 \geqq 2D_1$; the relation between the length $l_1$ and the diameter $d_1$ of each of said $n_1$ peripheral ducts 10 is $2d_1<l_1<5d_1$ and the relation between the overall cross sectional area $n_1s_1$ of said peripheral ducts 10 and the cross sectional area $S_1$ of the first cylindrical mixing chamber 9 is $0.5\ S_1<n_1S_1<S_1$.

The relation between said overall length $L_2$ and the diameter $D_2$ of said first portion of the second mixing chamber 12 is $0.6\ D_2<L_2<1.2\ D_2$ and the relation beteen said diameter $D_2$ of the second mixing chamber 12 and the diameter $D_1$ of the first cylindrical mixing chamber 9 is $D_2 \geqq 3D_1$.

The number $n_2$ of said outlet means 14 in the second mixing chamber 12 is $n_2>3$, the length $l_2$ and the diameter $d_2$ of said outlet means 14 are such that $d_2<l_2<3d_2$, and the cross sectional area $s_2$ of each of said outlet means 14 is such that $n_2s_2<n_1s_1+S_1$.

The paramount advantages of the novel atomizer are: the preliminary mixing between the liquid fuel and the atomizing fluid in the first mixing chamber is very effective; the length $L_3$ provides for satisfactory turbulence in the liquid fuel and the length $L_4$ provides for a first satisfactory mixing; the relations among the dimensions of the second mixing chamber prevent coalescence of the drops drawn by the atomizing fluid from the first chamber with the liquid fraction that has not been atomized in the first mixing chamber; the atomizing fluid is admitted separately from the jet of not yet atomized liquid fuel which facilitates subsequent spreading of said jet on the walls of the chamber in the form of a thin film that enters the outlet means where the atomizing fluid further atomizes the liquid fuel; and the relations among the cross sectional areas of the peripheral ducts, first mixing chamber and outlet means impart to the atomizing fluid such a pressure in the second mixing chamber that the above film in the outlet means is broken down to the maximum extent. As a whole, the final atomization of the liquid fuel is excellent.

We claim:

1. An atomizer for liquid fuel, comprising first inlet means for a liquid fuel, said first inlet means including a central inlet passage having a diameter $D_o$ and a predetermined length; second inlet means for an atomizing fluid disposed radially outwardly of said inlet passage; a first mixer including a first cylindrical mixing chamber communicating with said inlet passage and having a diameter $D_1$ such that $D_o/D_1$ is greater than 2, said first mixing chamber further having a length $L_1$ such that said predetermined length greatly exceeds $L_1$, and said first mixer also including at least three ducts disposed radially outwardly of said first mixing chamber and connecting the latter with said second inlet means, all of said ducts having essentially the same length $l_1$ and the same diameter $d_1$, and said ducts being substantially equally angularly spaced about said first mixing chamber and each having a longitudinal axis; and a second mixer including a second mixing chamber communicating with said first mixing chamber and having a cylindrical portion of diameter $D_2$ such that the cross-sectional area of said cylindrical portion is several times greater than the cross-sectional area of said first mixing chamber, said cylindrical portion further having a length $L_5$ such that $L_5/D_2$ is greater than 0.6, and said second mixing chamber additionally comprising a frustoconical portion having a peripheral frustoconical wall and a circular end wall of diameter $D_3$, said mixing chambers and said inlet passage having a common longitudinal axis, and the longitudinal axes of said ducts intersecting one another within said first mixing chamber at a first common point on said common longitudinal axis, said frustoconical wall being provided with a plurality of outlet passages having respective longitudinal axes which are substantially normal to said frustoconical wall and intersect one another within said cylindrical portion at a second common point on said common longitudinal axis, said end wall being substantially perpendicular to said common longitudinal axis, and the diameter $D_3$ of said end wall being such that $D_3$ is greater than or equal to the diameter $D_1$ of said first mixing chamber.

2. The atomizer of claim 1, wherein said first mixing chamber has a first portion of length $L_3$ extending from said first common point towards said inlet passage and a second portion of length $L_4$ extending from said first common point towards said second mixing chamber, $L_3$ plus $L_4$ being substantially equal to $L_1$, $L_3$ being less than or equal to $2D_1$, and $L_4$ being greater than or equal to $2D_1$, $l_1$ and $d_1$ being selected in such a manner that $2d_1$ is less than $l_1$ which is less than $5d_1$, and the number $n_1$ of said ducts being selected in such a manner that $0.5S_1$ is less than $n_1s_1$ which is less than $S_1$ where $s_1$ is the cross-sectional area of a duct and $S_1$ is the cross-sectional area of said first mixing chamber.

3. The atomizer of claim 1, wherein said second mixing chamber has a length $L_2$ such that $0.6D_2$ is less than $L_2$ which is less than $1.2D_2$, $D_2$ being greater than or equal to $3D_1$.

4. The atomizer of claim 1, wherein the number $n_2$ of said outlet passages exceeds 3, each of said outlet passages having a length $l_2$ and a diameter $d_2$ such that $d_2$ is less than $l_2$ which is less than $3d_2$, and $n_2s_2$ being less than $n_1s_1$ plus $S_1$ where $s_2$ is the cross-sectional area of an outlet passage, $n_1$ is the number of said ducts, $s_1$ is the cross-sectional area of a duct, and $S_1$ is the cross-sectional area of said first mixing chamber, said outlet passages having sharp inner and outer edges.

5. The atomizer of claim 1, wherein said first mixing chamber and said inlet passage have a common interface at which the diameter changes abruptly from $D_o$ to $D_1$.

6. The atomizer of claim 5, wherein said first mixing chamber and said cylindrical portion have a common interface at which the diameter changes abruptly from $D_1$ to $D_2$.

7. The atomizer of claim 6, wherein said ducts open into said first mixing chamber at locations spaced from both of said interfaces.

8. The atomizer of claim 1, wherein said ducts are inclined with reference to said common longitudinal axis.

* * * * *